US010345753B2

(12) United States Patent
Ueno

(10) Patent No.: US 10,345,753 B2
(45) Date of Patent: Jul. 9, 2019

(54) TRANSFER UNIT AND IMAGE FORMING APPARATUS INCLUDING SAME

(71) Applicant: KYOCERA Document Solutions Inc., Osaka (JP)

(72) Inventor: Masahiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 68 days.

(21) Appl. No.: 15/853,519

(22) Filed: Dec. 22, 2017

(65) Prior Publication Data

US 2018/0181031 A1 Jun. 28, 2018

(30) Foreign Application Priority Data

Dec. 28, 2016 (JP) ..... 2016-254679

(51) Int. Cl.

*G03G 15/00* (2006.01)
*G03G 15/16* (2006.01)
*G03G 21/16* (2006.01)

(52) U.S. Cl.

CPC ..... *G03G 15/657* (2013.01); *G03G 15/167* (2013.01); *G03G 15/1615* (2013.01); *G03G 21/168* (2013.01); *G03G 2215/00156* (2013.01); *G03G 2215/00413* (2013.01); *G03G 2221/1642* (2013.01); *G03G 2221/1657* (2013.01)

(58) Field of Classification Search

CPC ..... G03G 15/165; G03G 15/1665; G03G 15/167; G03G 15/1685; G03G 15/657; G03G 2215/00143; G03G 2215/00156; G03G 2215/00413

USPC ..... 399/313, 316, 400

See application file for complete search history.

(56) References Cited

U.S. PATENT DOCUMENTS 6,108,514 A * 8/2000 Nakayama ..... G03G 15/657 399/400
8,290,413 B2 * 10/2012 Kobayashi ..... G03G 15/0194 399/299
2011/0293336 A1 12/2011 Noso et al. ..... 399/302
2015/0078792 A1 3/2015 Aoyagi et al. ..... 399/302

FOREIGN PATENT DOCUMENTS

JP 2011-252958 A 12/2011
JP 2015-60064 A 3/2015

* cited by examiner

*Primary Examiner* — Benjamin R Schmitt
(74) *Attorney, Agent, or Firm* — Stein IP, LLC

(57) ABSTRACT

A transfer unit includes an endless belt member, belt support rollers, a frame, a meandering detecting sensor, an alignment adjusting mechanism, and a conveyance guide disposed on a downstream side of the belt member with respect to a recording-medium conveyance direction. The alignment adjusting mechanism, based on a detection result of the meandering detecting sensor, causes one end portion of a downstream-side belt support roller of the belt support rollers which is adjacent to the conveyance guide to move along the recording-medium conveyance direction. The alignment adjusting mechanism causes a first end portion of the conveyance guide disposed on a same side as the one end portion of the downstream-side belt support roller to move following movement of the one end portion of the downstream-side belt support roller, and thereby maintains a distance between the belt member and the conveyance guide constant.

6 Claims, 6 Drawing Sheets

TRANSFER UNIT AND IMAGE FORMING APPARATUS INCLUDING SAME

INCORPORATION BY REFERENCE

This application is based upon and claims the benefit of priority from the corresponding Japanese Patent Application No. 2016-254679 filed on Dec. 28, 2016, the entire contents of which are incorporated herein by reference.

BACKGROUND

The present disclosure relates to a transfer unit which is incorporated in image forming apparatuses such as electrophotographic copiers, printers, facsimile machines, and multifunction peripherals having functions of these, and which transfers a toner image formed on an image carrier onto a recording medium such as a sheet which is electrostatically adsorbed onto a conveyance belt, and the present disclosure also relates to an image forming apparatus including such a transfer unit.

In image forming apparatuses, such as copiers, printers, and facsimile machines, using an electro-photographic method, a powdery developer (toner) is mainly used, and the following process is generally performed. That is, a photosensitive layer on a surface of a photosensitive drum (image carrier) is charged by a charging device to a predetermined surface potential (of the same polarity as charge polarity of toner), and then, an electrostatic latent image is formed on the photosensitive drum by an exposure device. Then, the resulting electrostatic latent image is visualized as a toner image with the toner in a developing device, the resulting toner image is transferred onto a sheet (recording medium) passing through a transfer section disposed facing the photosensitive drum, and thereafter, fixing processing is performed on the transferred toner image.

A known transfer unit is provided with a conveyance belt such that a toner image is transferred onto a sheet conveyed by being electrostatically adsorbed onto the conveyance belt. With this configuration, the conveyance belt is sometimes caused to meander or deviate from its position. The meandering or the deviation of the conveyance belt causes the position of a sheet under conveyance to shift in the sheet width direction, which is likely to invite inconveniences such as a displaced image transfer and a sheet jam.

To prevent such inconveniences, there has been proposed a method for automatically correcting meandering or deviation of the conveyance belt by detecting meandering or deviation of the conveyance belt by a sensor and adjusting the alignment (the angle in the belt thickness direction) of at least one suspension roller in accordance with the amount of meandering or the amount of deviation detected by the sensor. For example, there is known a belt conveyance device that includes meandering detection means which detects meandering of an endless belt, and an alignment adjusting mechanism which corrects meandering of the endless belt by adjusting the inclination of at least one suspension roller based on the detection result provided by the meandering detection means.

There is also known a belt conveyance device which has an endless belt and a plurality of rollers between which the endless belt is stretched, and which receives an image at a predetermined image receiving position on the endless belt, in the conveyance direction of the endless belt, directly or via a transfer member, wherein at least one of the plurality of rollers is a steering roller which is disposed on the upstream or downstream side of the image receiving position, and whose disposition angle with respect to the endless belt can be varied by inclining the steering roller.

SUMMARY

According to one aspect of the present disclosure, a transfer unit includes a belt member, a plurality of belt support rollers, a frame, a meandering detecting sensor, an alignment adjusting mechanism, and a conveyance guide. The transfer unit applies to the belt member a transfer voltage of polarity opposite to polarity of toner to thereby transfer a toner image carried on an image carrier onto a recording medium passing through a nip portion between the image carrier and the belt member. The belt member is endless and in contact with the image carrier which carries the toner image. The belt member is stretched between the belt support rollers. The frame rotatably supports both ends of each of the plurality of belt support rollers. The meandering detecting sensor detects meandering of the belt member. The alignment adjustment mechanism corrects meandering of the belt member by adjusting inclination of one or more of the plurality of belt support rollers based on a result of detection performed by the meandering detecting sensor. The conveyance guide is disposed on a downstream side of the belt member with respect to a recording-medium conveyance direction, at a predetermined distance from the belt member. The alignment adjusting mechanism causes one end portion of a downstream-side belt support roller of the plurality of belt support rollers which is adjacent to the conveyance guide to move along the recording-medium conveyance direction, and the alignment adjusting mechanism causes a first end portion of the conveyance guide disposed on a same side as the one end portion of the downstream-side belt support roller to move following movement of the one end portion of the downstream-side belt support roller, and thereby maintains a distance between the belt member and the conveyance guide constant.

Further features and specific advantages of the present disclosure will become apparent from the following descriptions of preferred embodiments.

DETAILED DESCRIPTION

Figure 1:
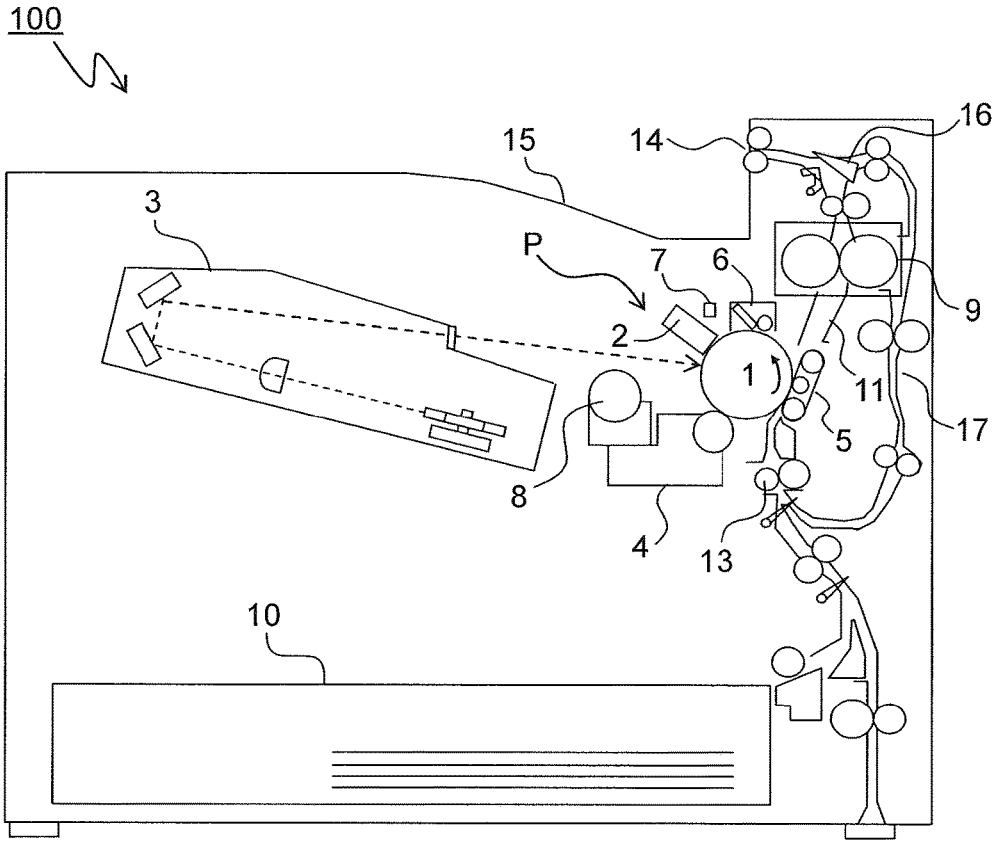
FIG. 1 is a schematic diagram showing an overall configuration of an image forming apparatus incorporating a transfer unit of the present disclosure.
Figure 2:
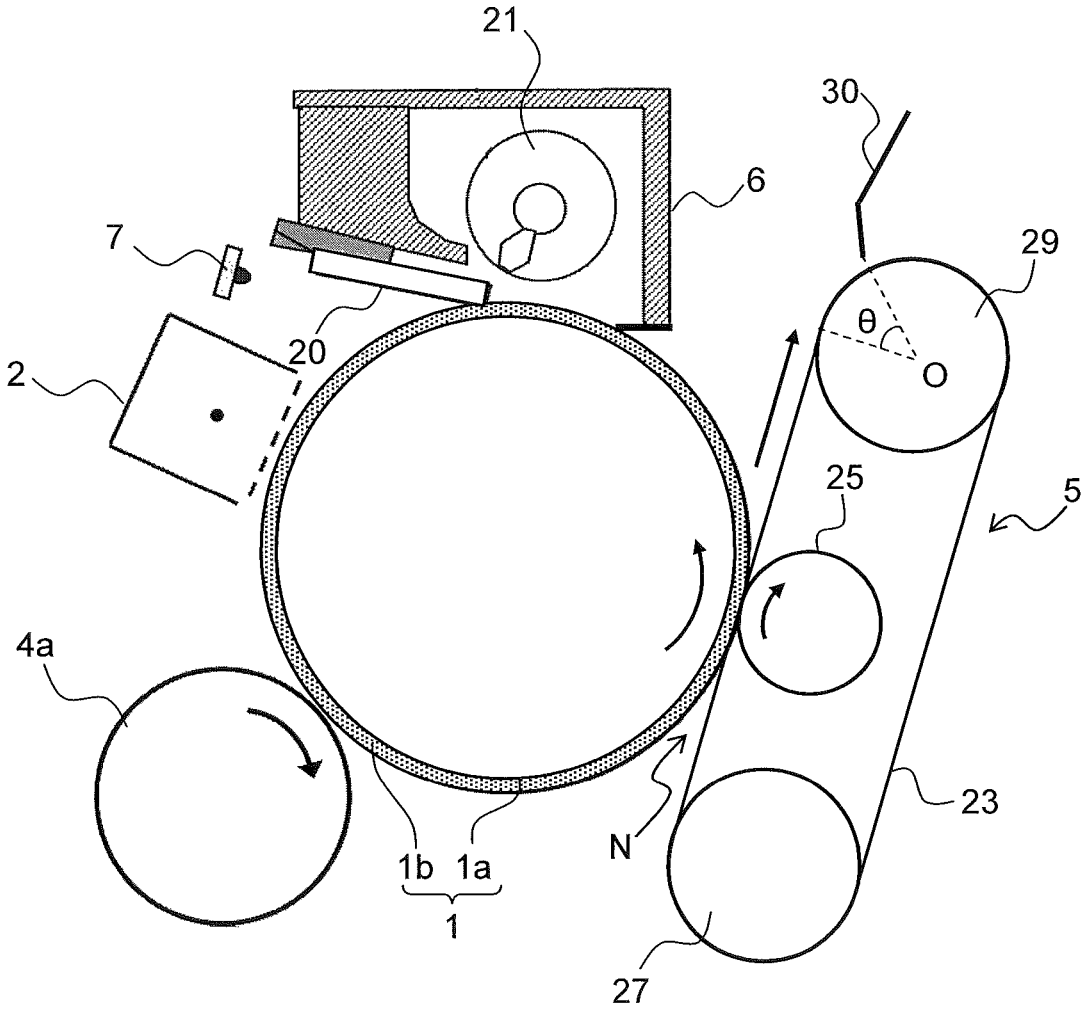
FIG. 2 is a partial enlarged view of an image forming section of the image forming apparatus shown in FIG. 1.

Hereinafter, embodiments of the present disclosure will be described with reference to the drawings. FIG. 1 is a schematic diagram showing an overall configuration of an image forming apparatus 100 incorporating a transfer unit 5 of the present disclosure, and FIG. 2 is a partial enlarged view of an image forming section P of the image forming apparatus 100 shown in FIG. 1. In a main body of the image forming apparatus (for example, a monochrome printer) 100, the image forming section P is disposed which forms a monochrome image through processes of charging, exposure, development, and transfer.

In the image forming section P, a photosensitive drum 1 is disposed, and a charging device 2, an exposure device 3, a developing device 4, the transfer unit 5, a cleaning device 6, and a charge eliminating device 7 are disposed along a rotation direction of the photosensitive drum 1 (the counterclockwise direction in FIG. 1). In the image forming section P, an image forming process is performed with respect to the photosensitive drum 1 while the photosensitive drum 1 is being rotated in the counterclockwise direction in FIG. 1.

The photosensitive drum 1 is formed by laying a photosensitive layer 1*b* on an outer circumferential surface of a drum base tube 1*a* made of aluminum, and the photosensitive layer 1*b* is charged by the charging device 2. Then, on a surface of the photosensitive layer 1*b* which has been irradiated with a laser beam from the exposure device 3, which will be described later, an electrostatic latent image is formed through attenuation of electric charge. In the present embodiment, the photosensitive layer 1*b* is an organic photosensitive layer (OPC), with which the amount of ozone generated is small when the photosensitive drum 1 is charged, and with which high-resolution images can be obtained.

The charging device 2 uniformly charges the surface of the photosensitive drum 1. In the present embodiment, the charging device 2 is of a scorotron charging type, provided with a colona wire and a grid disposed between the colona wire and the photosensitive drum 1, such that a high voltage is applied to the grid to cause a discharge. Here, a charging roller may be used as the charging device, which contacts the photosensitive drum 1 to uniformly charge the surface of the photosensitive drum 1. The exposure device 3 emits laser beam toward the photosensitive drum 1 based on image data, thereby forming an electrostatic latent image according to the image data on the surface of the photosensitive drum 1.

The transfer unit 5 transfers a toner image formed on the surface of the photosensitive drum 1 onto a sheet conveyed thereto through a sheet conveyance passage 11. As shown in FIG. 2, the transfer unit 5 is provided with a conveyance belt 23, a transfer roller 25, a first belt support roller 27, a second belt support roller 29, and a conveyance guide 30.

The conveyance belt 23 is an endless belt member stretched under predetermined tension between the first belt support roller 27 and the second belt support roller 29. The conveyance belt 23 is, for example, a belt made by coating an outer circumferential surface of a rubber belt member with a fluororesin. The conveyance belt 23 forms a nip portion N (a transfer nip portion) at a position at which it contacts the photosensitive drum 1.

The transfer roller 25 contacts an inner circumferential surface of the conveyance belt 23 at the nip portion N. By applying a voltage of negative polarity (polarity opposite to polarity of toner) to the transfer roller 25 from a transfer voltage power supply 54 (see FIG. 3), a discharge is caused between the transfer roller 25 and the conveyance belt 23 at the nip portion N to thereby give negative-polarity charge to the conveyance belt 23.

The first belt support roller 27 and the second belt support roller 29 are disposed on an upstream side and a downstream side, respectively, with respect to a sheet-conveyance direction, and each have both ends thereof rotatably supported by a frame 5*a* (see FIG. 4) of the transfer unit 5. The first belt support roller 27 or the second belt support roller 29 is driven to rotate by a belt drive motor (unillustrated) to cause the conveyance belt 23 to move in the sheet-conveyance direction (a direction indicated by an arrow in FIG. 2).

With this configuration, the sheet is caused to be electrostatically adsorbed onto the outer circumference surface of the conveyance belt 23 by the charge given to the conveyance belt 23, and conveyed via the nip portion N between the conveyance belt 23 and the photosensitive drum 1. When the sheet passes through the nip portion N, the toner image formed on the photosensitive drum 1 is attracted toward the conveyance belt 23 to which the negative-polarity charge has been given, and thereby the toner image is transferred onto the sheet.

The conveyance guide 30 guides the sheet separated from the conveyance belt 23 at a downstream-side end portion of the transfer unit 5. The sheet guided by the conveyance guide 30 is led via the sheet conveyance passage 11 to a fixing section 9. In the present embodiment, being disposed in a predetermined attitude with respect to a moving path of the conveyance belt 23, the conveyance guide 30 supports the motion of the sheet separating from the conveyance belt 23 by means of self stripping. For example, the conveyance guide 30 is arranged such that an angle formed between a straight line extending from an axial center O of the second belt support roller 29 toward a contact point between the conveyance belt 23 and the second belt support roller 29 and a straight line extending from the axial center O of the second belt support roller 29 toward an upstream-side end portion of the conveyance guide 30 with respect to the sheet conveyance direction is within a range not smaller than 30° but not larger than 60°.

The cleaning device 6 includes a cleaning blade 20, which is in line contact with the photosensitive drum 1 in a longitudinal direction of the photosensitive drum 1, and a collection spiral 21 which discharges waste toner scraped off from the surface of the photosensitive drum 1 by the cleaning blade 20. The cleaning device 6 removes residual toner remaining on the surface of the photosensitive drum 1 after the toner image is transferred onto the sheet. The charge eliminating device 7 irradiates the surface of the photosensitive drum 1 with charge eliminating light to remove residual charge therefrom.

In case where a printing operation is performed, image data received from a host apparatus such as a personal computer is converted into an image signal. On the other hand, in the image forming section P, the photosensitive drum 1, rotating in the counterclockwise direction in the figure, is uniformly charged by the charging device 2. Then, the photosensitive drum 1 is irradiated with a light beam by the exposure device 3 based on the image signal, whereby an electrostatic latent image based on the image data is formed on the surface of the photosensitive drum 1. Thereafter, toner carried on a developing roller 4*a* of the developing device 4 is made to adhere to the electrostatic latent image, whereby a toner image is formed. Toner is supplied to the developing device 4 from a toner container 8.

Toward the image forming section P, where the toner image has been formed as described above, the sheet is conveyed from a sheet container section 10 via the sheet conveyance passage 11 and a registration roller pair 13, at a predetermined timing. Then, in the nip portion N between the photosensitive drum 1 and the conveyance belt 23 of the transfer unit 5, the toner image formed on the surface of the photosensitive drum 1 is transferred onto the sheet. The sheet onto which the toner image has been transferred is separated from the photosensitive drum 1 to be conveyed to the fixing section 9, where the sheet is heated and pressed, whereby the toner image is fixed on the sheet. The sheet which has passed through the fixing section 9 is guided into a direction by a branching guide 16 disposed at a branching portion of the sheet conveyance passage 11, and then, the sheet is ejected as it is (or after it is sent to a reverse conveyance path 17 and double-sided printing is completed thereon) to a sheet ejection section 15 via an ejection roller pair 14.

Figure 3:
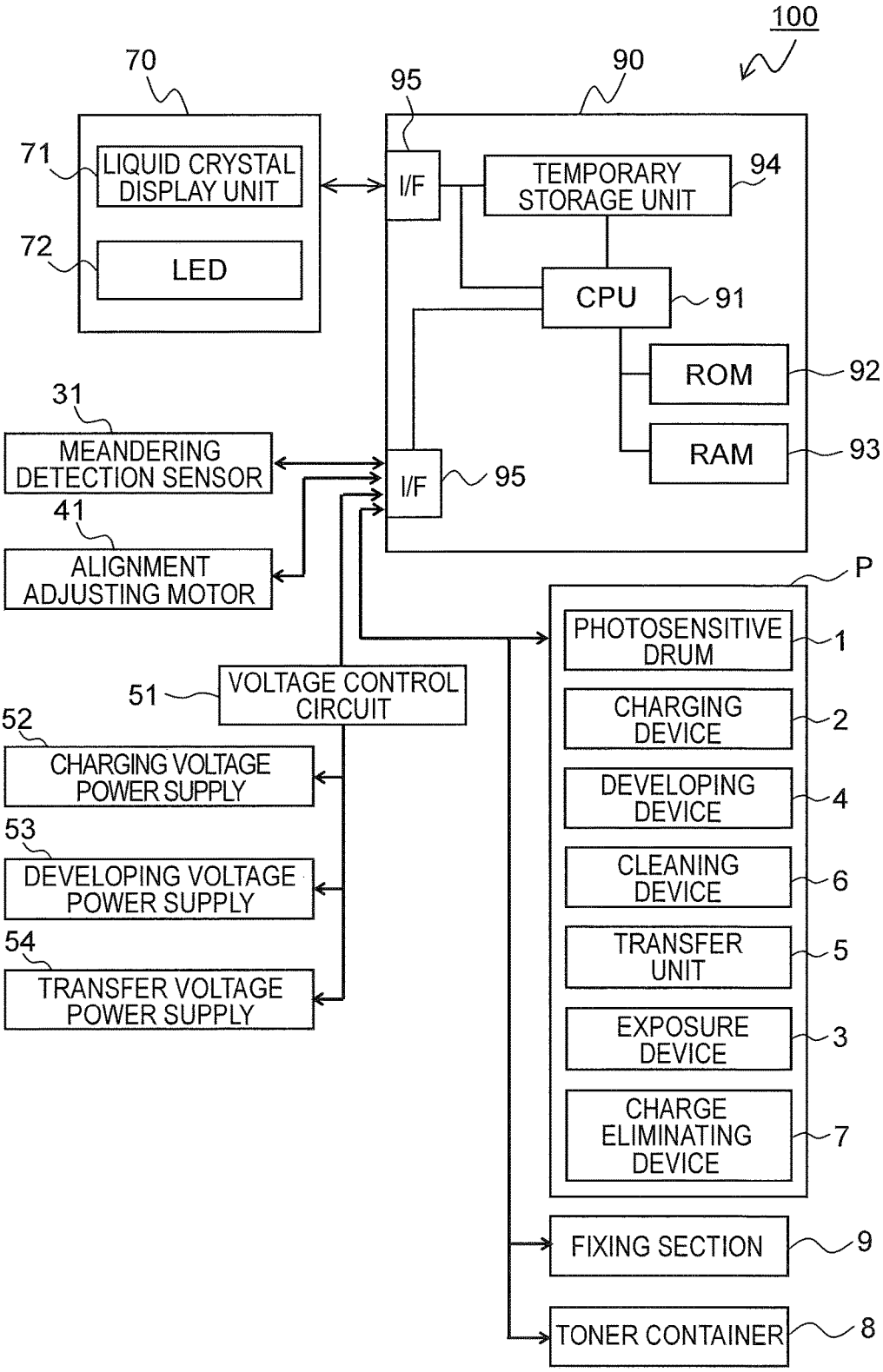
FIG. 3 is a block diagram showing an example of control path used in the image forming apparatus.

FIG. 3 is a block diagram showing an example of control path used in the image forming apparatus 100. In using the image forming apparatus 100, various forms of control are performed with respect to the various sections and units of the apparatus, which renders a control path of the image forming apparatus 100 as a whole complex. In view of this, the following description is focused on such part of the control path as is necessary for practice of the present disclosure.

A voltage control circuit 51 is connected to a charging voltage power supply 52, a developing voltage power supply 53, and a transfer voltage power supply 54, and makes these power supplies 52 to 54 operate in accordance with a signal from the control section 90. In response to a control signal from the voltage control circuit 51, the power supplies 52 to 54 apply a predetermined voltage to the charging device 2, the developing roller 4*a*, and the transfer roller 25, respectively.

An operation section 70 is provided with a liquid crystal display 71 and an LED 72 indicating various information, such that conditions of the image forming apparatus 100, conditions of image-forming operation, a number of prints, etc. are displayed. Various settings regarding the image forming apparatus 100 are made via a printer driver of a personal computer.

The control section 90 at least includes a central processing unit (CPU) 91, a read only memory (ROM) 92, which is a storage exclusively for reading therefrom, a random access memory (RAM) 93, which is a readable and writable storage, a temporary storage 94, which temporarily stores therein image data and the like, and a plurality of (here, two) interfaces (I/Fs) 95, which transmit control signals to respective devices in the image forming apparatus 100 and receive signals inputted via the operation section 70. The control section 90 can be disposed anywhere inside the main body of the image forming apparatus 100.

The control section 90 transmits control signals to sections and devices in the image forming apparatus 100 from the CPU 91 via the I/Fs 95. From the sections and the devices, signals indicating their states and input signals are transmitted to the CPU 91 via the I/Fs 95. Examples of sections and devices controlled by the control section 90 include, for example, the image forming section P, the fixing section 9, an alignment adjusting motor 41, the voltage control circuit 51, the operation section 70, etc.

The ROM 92 stores therein control programs for the image forming apparatus 100, numeral values and the like necessary for the control, such data as is not changed during use of the image forming apparatus 100, and so on. In the RAM 93, necessary data generated in a course of control of the image forming apparatus 100, data temporarily required for controlling the image forming apparatus 100, and so on are stored.

A meandering detecting sensor 31 detects meandering of the conveyance belt 23 included in the transfer unit 5. In the present embodiment, the meandering detecting sensor 31 is a transmissive photo interrupter (PI), which has a U-shaped detector provided with a light emitter and a light receiver (not shown), and is disposed such that an edge portion of the conveyance belt 23 is sandwiched, in its thickness direction, between two facing parts of the U-shaped detector. The meandering detecting sensor 31 detects a position of the edge portion by means of a position where an edge of the conveyance belt 23 blocks a path of light from the light emitter to the light receiver, and thereby is capable of detecting a meandering direction and a meandering amount of the conveyance belt 23. The alignment adjusting motor 41 rotates by a predetermined amount in a predetermined direction based on a result of detection performed by the meandering detecting sensor 31, whereby alignment of the second belt support roller 29 stretching the conveyance belt 23 is adjusted.

Figure 4:
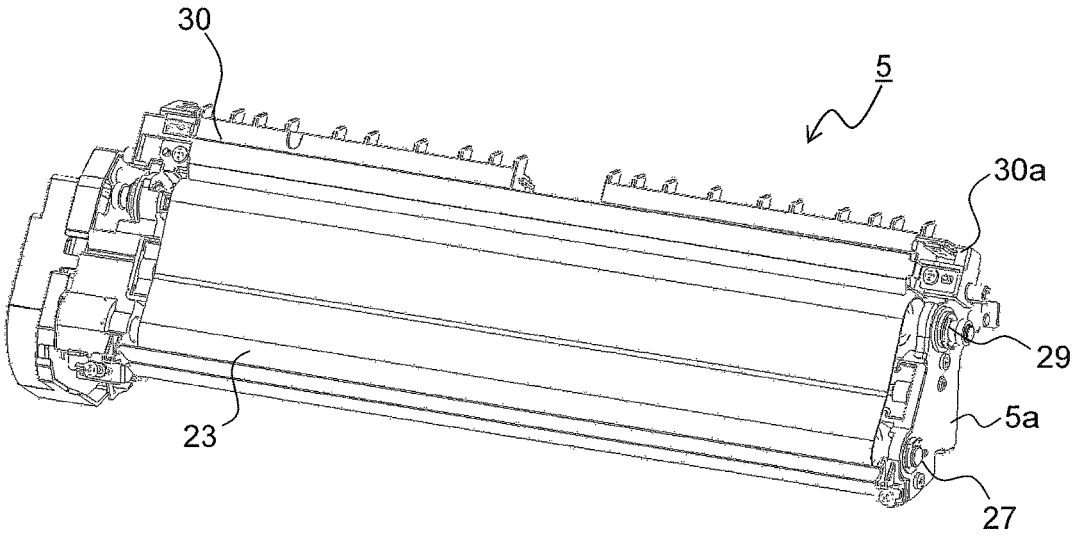
FIG. 4 is a perspective view of a transfer unit according to a first embodiment of the present disclosure as seen from a side of a nip portion between the transfer unit and a photosensitive drum (from a left side in FIG. 2)
Figure 5:
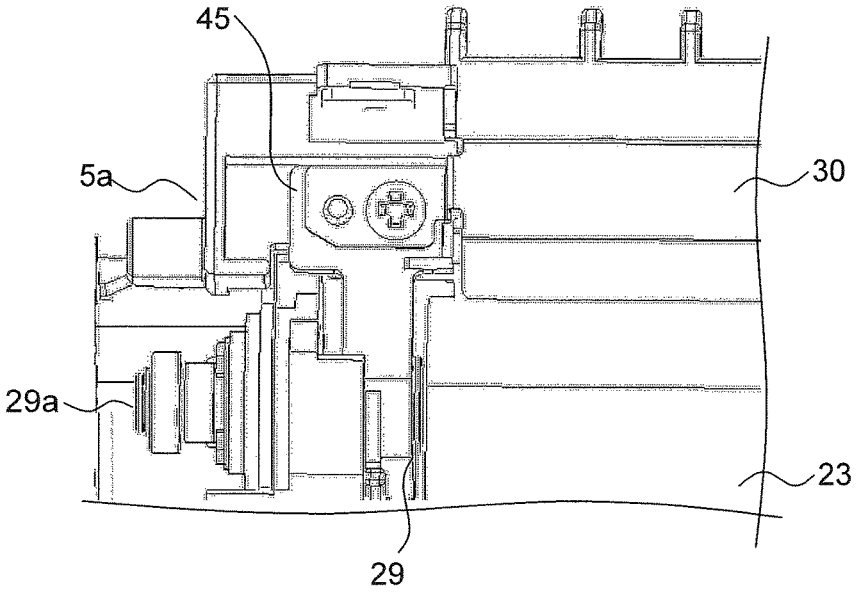
FIG. 5 is a partial enlarged view of a widthwise end side of the transfer unit of the first embodiment.
Figure 6:
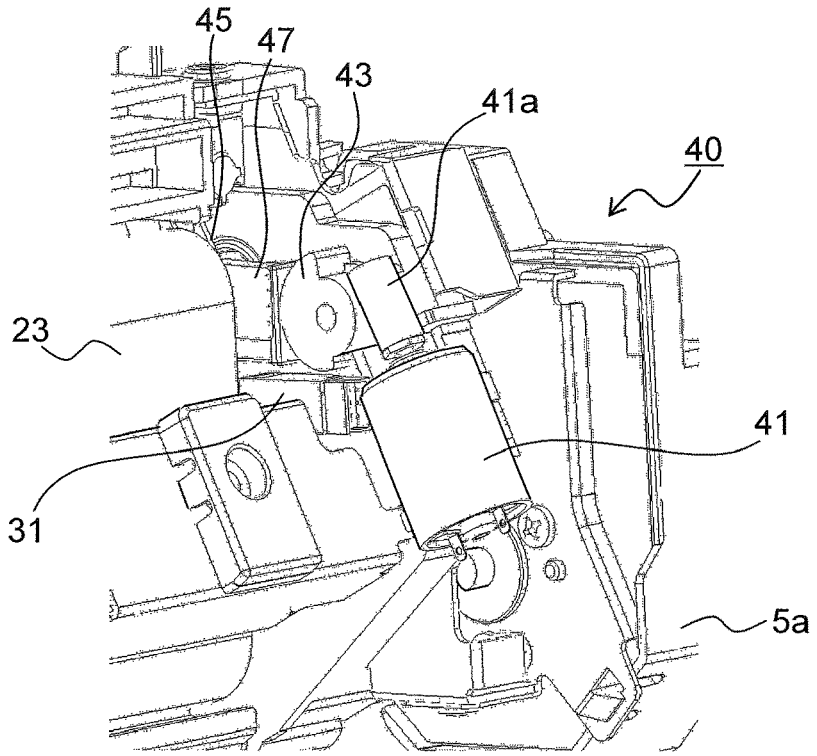
FIG. 6 is a perspective view of an alignment adjusting mechanism provided on a widthwise end side of the transfer unit of the first embodiment.
Figure 7:
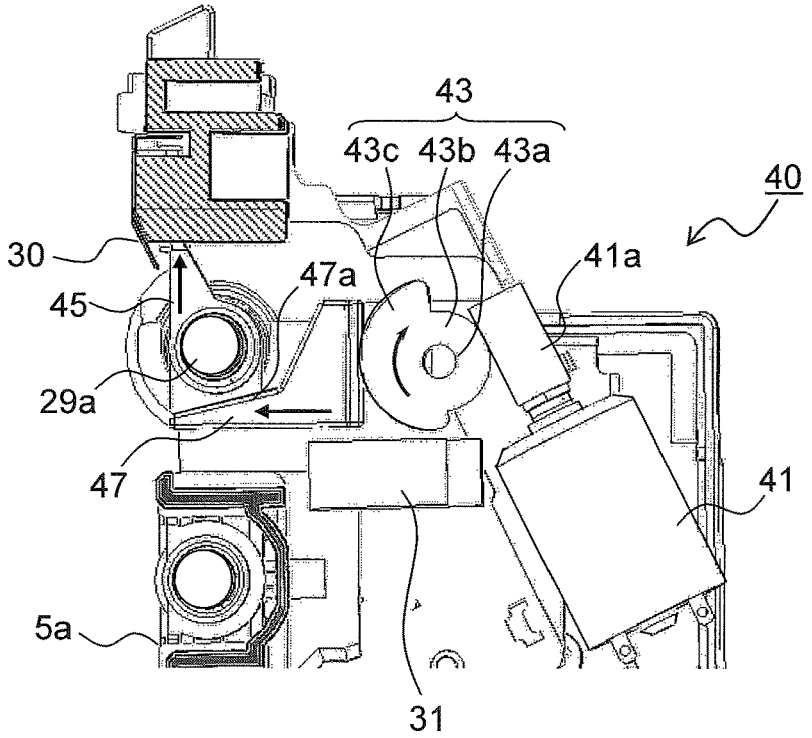
FIG. 7 is a side view of the alignment adjusting mechanism as seen from a left side in FIG. 6.

FIG. 4 is a perspective view of a transfer unit 5 according to a first embodiment of the present disclosure used in the image forming apparatus 100, as seen from a side of the nip portion N between the transfer unit 5 and the photosensitive drum 1 (from the left side in FIG. 2), and FIG. 5 is a partial enlarged view of a widthwise end side (a left end portion) of the transfer unit 5. FIG. 6 is a perspective view of an alignment adjusting mechanism 40 provided on a widthwise end side of the transfer unit 5, and FIG. 7 is a side view of the alignment adjusting mechanism 40.

The conveyance guide 30 is made by bending a metal sheet, and the transfer voltage power supply 54 (see FIG. 3) is connected to the conveyance guide 30. During image formation, a voltage of polarity (here, negative polarity) opposite to the polarity of toner is applied to the conveyance guide 30, whereby negative-polarity charge is given via the conveyance guide 30 to a sheet. As a result, potential difference between the sheet and the conveyance belt 23 is reduced, and this makes it possible to reduce occurrence of peeling discharge when the sheet leaves the conveyance belt 23. The sheet given the negative-polarity charge enhances adhesive power of toner adhered thereto and having positive polarity, and this makes it possible to reduce scattering of toner and electrostatic offset caused thereby.

On a surface of the conveyance guide 30, a sheet-shaped insulating member (not shown) is provided, such that the sheet does not directly contact the conveyance guide 30. This makes it possible to reduce occurrence of peeling discharge when the sheet leaves the conveyance guide 30.

The alignment adjusting mechanism 40 includes the alignment adjusting motor 41, a cam member 43, a first actuator 45, and a second actuator 47. The alignment adjusting motor 41 is a stepping motor whose rotation direction and rotation angle are controllable with high accuracy by means of drive pulse control, and a worm gear 41*a* is fastened to a drive output shaft of the alignment adjusting motor 41.

The cam member 43 has a rotation shaft 43*a* which is rotatably supported by the frame 5*a*, a gear portion 43*b* which meshes with the worm gear 41*a*, and an eccentric cam portion 43*c*. A distance from an outer circumferential surface of the eccentric cam portion 43*c* to the rotation shaft 43*a* continuously varies. The first actuator 45 is slidably disposed around the rotary shaft 29*a* of the second belt support roller 29, and is supported to be movable with respect to the frame 5*a* in the sheet conveyance direction (an up-down direction in FIG. 7). The second actuator 47 is disposed between the cam member 43 and the first actuator 45, and is supported to be movable in a thickness direction of the sheet (a left-right direction in FIG. 7) perpendicular to the sheet conveyance direction with respect to the frame 5*a*.

On detecting meandering of the conveyance belt 23, the meandering detecting sensor 31 transmits a detection signal to the control section 90 (see FIG. 3), and the control section 90 calculates the meandering direction and the meandering amount of the conveyance belt 23. Then, the control section 90 transmits a control signal to the alignment adjusting motor 41, to rotate the cam member 43 by a predetermined amount in a predetermined direction via the worm gear 41*a*.

Thereby, the distance from the outer circumferential surface of the eccentric cam portion 43*c* to the rotation shaft 43*a* varies, as a result of which the second actuator 47 swings leftward or rightward, and the first actuator 45, which abuts on an inclined surface 47*a* of the second actuator 47, also moves upward or downward. Accordingly, one end of the rotation shaft 29*a* of the second belt support roller 29 swings together with the first actuator 45, and thus, it is possible to correct the meandering of the conveyance belt 23, which is stretched by the second belt support roller 29, by inclining the conveyance belt 23 by a predetermined angle.

For example, in a case where the conveyance belt 23 has meandered to a rear side (leftward in FIG. 4) of the image forming apparatus 100, the cam member 43 is caused to rotate in a clockwise direction in FIG. 7 to thereby cause the first actuator 45 to move upward to cause a rear end portion of the second belt support roller 29 to move upward (move to a downstream side in the sheet conveyance direction) by a predetermined distance. Thereby, the conveyance belt 23 becomes inclined upward from a front side (a right side in FIG. 4) to the rear side (a left side in FIG. 4) of the image forming apparatus 100, the conveyance belt 23 is gradually displaced frontward as it rotates, and thereby the rearward meandering of the conveyance belt 23 is corrected.

On the other hand, in a case where the conveyance belt 23 has meandered to the front side (the right side in FIG. 4) of the image forming apparatus 100, the cam member 43 is caused to rotate in a reverse direction (a counterclockwise direction in FIG. 7) to thereby cause the rear end portion of the second belt support roller 29 to move downward (move to an upstream side in the sheet conveyance direction) such that the conveyance belt 23 becomes inclined upward from the rear side to the front side.

In the present embodiment, as shown in FIG. 5, one end side (a first end portion) of the conveyance guide 30 is screw-fastened to the first actuator 45. The other end side (a second end portion) of the conveyance guide 30 is swingably supported by a guide support frame 30*a* (see FIG. 4), which is coupled to a downstream side of the frame 5*a* of the transfer unit 5 with respect to the sheet conveyance direction. With this configuration, along with the movement of the first actuator 45, the one end side of the second belt support roller 29 and the one end side of the conveyance guide 30 move in the same direction by the same distance. Accordingly, even in a case where the meandering of the conveyance belt 23 is corrected, a distance between the conveyance belt 23, stretched by the second belt support roller 29, and the conveyance guide 30 is maintained constant, and thus, it is possible to effectively reduce winding of the sheet around the conveyance belt 23 or sheet jam caused if the distance between the conveyance belt 23 and the conveyance guide 30 is increased.

Figure 8:
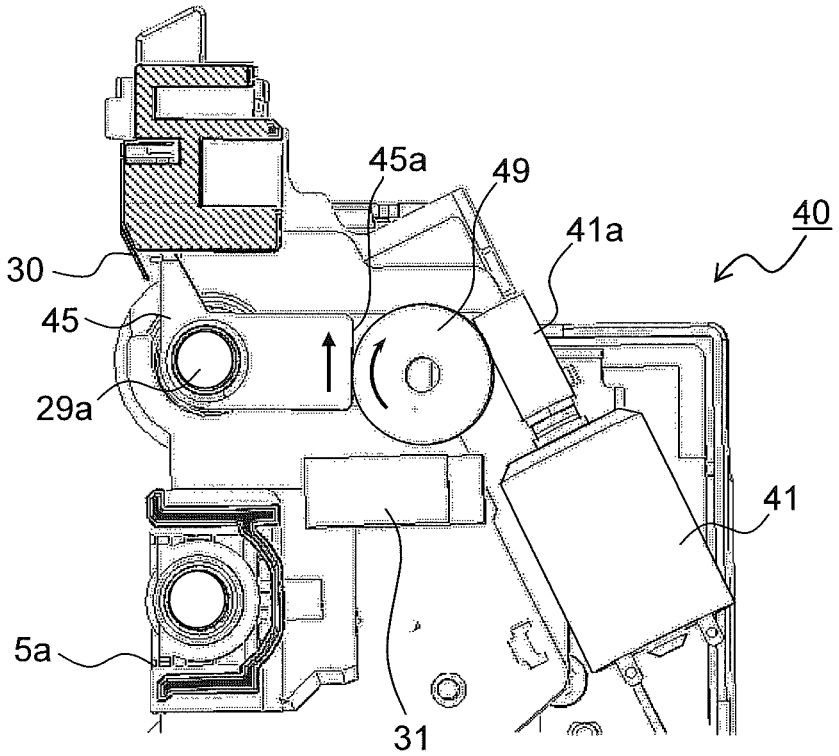
FIG. 8 is a side view of the alignment adjusting mechanism provided on an end side of a transfer unit according to a second embodiment of the present disclosure.

FIG. 8 is a side view of an alignment adjusting mechanism 40, which is provided on a widthwise end side of a transfer unit 5 according to a second embodiment of the present disclosure. In the present embodiment, instead of the cam member 43, an idle gear 49 is disposed which meshes with the worm gear 41*a*. The second actuator 47 is not provided, and the first actuator 45 has formed thereon a rack portion 45*a*, which meshes with the idle gear 49. Configurations of the other portions of the transfer unit 5 and the alignment adjusting mechanism 40 are the same as in the first embodiment.

In the present embodiment, too, like in the first embodiment, based on a detection signal received from the meandering detecting sensor 31, the control section 90 (see FIG. 3) calculates the meandering direction and the meandering amount of the conveyance belt 23. Then, the control section 90 transmits a control signal to the alignment adjusting motor 41, to rotate the idle gear 49 by a predetermined amount in a predetermined direction via the worm gear 41*a*.

Along with the rotation of the idle gear 49, drive force is transmitted from the idle gear 49 to the rack portion 45*a* to cause the first actuator 45 to move upward or downward in FIG. 7. Thereby, it is possible to correct meandering of the conveyance belt 23, which is stretched by the second belt support roller 29, by inclining the conveyance belt 23 by a predetermined angle.

In the present embodiment, too, one end side (the first end portion) of the conveyance guide 30 is screw-fastened to the first actuator 45, and the other end side (the second end portion) of the conveyance guide 30 is swingably supported by the guide support frame 30*a*, and accordingly, even in a case where the meandering of the conveyance belt 23 is corrected, the distance between the conveyance belt 23, stretched by the second belt support roller 29, and the conveyance guide 30 is maintained constant. Thus, it is possible to effectively reduce winding of the sheet around the conveyance belt 23 or sheet jam.

It should be understood that the present disclosure is not limited to the above embodiments, and various modifications are possible within the scope of the present disclosure. For example, although a transmissive PI sensor provided with a light emitter and a light receiver is used as the meandering detecting sensor 31 in the above embodiments, other types of sensors may be used instead, such as a reflective sensor which emits light to a surface of the conveyance belt 23 and measures light reflected from the surface of the conveyance belt 23. Marking may be applied to the surface of the conveyance belt 23 for detecting meandering of the conveyance belt 23.

The shape and the dimensions of the cam member 43 in the first embodiment are merely examples, and an amount of displacement of the eccentric cam portion 43*c* per unit angle is changeable as necessary in accordance with an alignment adjusting width and adjusting accuracy required to correct meandering of the conveyance belt 23.

In each of the above embodiments, a monochrome printer is dealt with as an example of the image forming apparatus 100, but application of the present disclosure is not limited to monochrome printers, but the present disclosure is applicable to other types of image forming apparatuses, such as monochrome and color copiers, digital multifunction peripherals, color printers, and facsimile machines, incorporating a transfer unit having a belt member.

The present disclosure is usable in image forming apparatuses incorporating a transfer unit having an endless belt member and a conveyance guide disposed adjacent to the belt member. By using the present disclosure, it is possible to provide a transfer unit capable of automatically correcting meandering of a belt member, and also capable of maintaining a constant distance between the belt member and a conveyance guide disposed on the downstream side of the belt member, and to provide an image forming apparatus incorporating such a transfer unit.

What is claimed is:

1. A transfer unit comprising:

a belt member which is endless and in contact with an image carrier which carries a toner image;

a plurality of belt support rollers which stretch the belt member therebetween;

a frame which rotatably supports both end portions of each of the plurality of belt support rollers;

a meandering detecting sensor which detects meandering of the belt member;

an alignment adjusting mechanism which corrects meandering of the belt member by adjusting inclination of one or more of the plurality of belt support rollers based on a result of detection performed by the meandering detecting sensor; and a conveyance guide which is disposed on a downstream side of the belt member with respect to a recording-medium conveyance direction, at a predetermined distance from the belt member, the transfer unit applying to the belt member a transfer voltage of polarity opposite to polarity of toner to thereby transfer the toner image carried on the image carrier onto a recording medium passing through a nip portion between the image carrier and the belt member, wherein the alignment adjusting mechanism causes one end portion of a downstream-side belt support roller of the plurality of belt support rollers which is adjacent to the conveyance guide to move along the recording-medium conveyance direction, and the alignment adjusting mechanism causes a first end portion of the conveyance guide disposed on a same side as the one end portion of the downstream-side belt support roller to move following movement of the one end portion of the downstream-side belt support roller, and thereby maintains a distance between the belt member and the conveyance guide constant.

2. The transfer unit of claim 1, wherein the alignment adjusting mechanism includes a cam member, an alignment adjusting motor which causes the cam member to rotate, and an actuator which causes, by means of rotation of the cam member, the one end portion of the downstream-side belt support roller to move along the recording-medium conveyance direction, wherein the first end portion of the conveyance guide is coupled to the actuator, and a second end portion of the conveyance guide, the second end portion being disposed opposite from the first end portion, is swingably supported by the frame.

3. The transfer unit of claim 2, wherein the actuator includes a first actuator which is slidably disposed around a rotation shaft of the downstream-side belt support roller, and a second actuator which causes the cam member to rotate to cause the first actuator to move along the recording-medium conveyance direction, and the first end portion of the conveyance guide is coupled to the first actuator.

4. The transfer unit of claim 1, wherein the alignment adjusting mechanism includes a gear member, an alignment adjusting motor which causes the gear member to rotate, and an actuator in which a rack portion which, meshes with the gear member is formed and which causes, by means of rotation of the gear member, the one end portion of the downstream-side belt support roller to move along the recording-medium conveyance direction, and the first end portion of the conveyance guide is coupled to the actuator, and a second end portion of the conveyance guide, the second end portion being disposed opposite from the first end portion, is swingably supported by the frame.

5. The transfer unit of claim 1, wherein the conveyance guide is made of a conductive material, and a voltage of polarity opposite to the polarity of the toner is applied to the conveyance guide during image formation.

6. An image forming apparatus comprising:

the transfer unit of claim 1;

a transfer voltage power supply which applies the transfer voltage to the belt member; and a control section which calculates a meandering direction and a meandering amount of the belt member based on a detection signal transmitted from the meandering detecting sensor, and which controls driving of the alignment adjusting mechanism based on a calculation result.

* * * * *